US009835177B1

(12) United States Patent
Gartman

(10) Patent No.: US 9,835,177 B1
(45) Date of Patent: Dec. 5, 2017

(54) SELF-CONTAINED DEPTH COMPENSATED ACCUMULATOR SYSTEM

(71) Applicant: Allen Russell Gartman, El Lago, TX (US)

(72) Inventor: Allen Russell Gartman, El Lago, TX (US)

( * ) Notice: Subject to any disclaimer, the term of this patent is extended or adjusted under 35 U.S.C. 154(b) by 385 days.

(21) Appl. No.: 14/678,839

(22) Filed: Apr. 3, 2015

Related U.S. Application Data

(60) Provisional application No. 61/991,836, filed on May 12, 2014.

(51) Int. Cl.
*F15B 1/04* (2006.01)
*F15B 1/033* (2006.01)
*F15B 1/16* (2006.01)

(52) U.S. Cl.
CPC ..... *F15B 1/033* (2013.01); *F15B 1/165* (2013.01); *F15B 2201/22* (2013.01); *F15B 2201/411* (2013.01)

(58) Field of Classification Search
CPC . F15B 1/165; F15B 2201/22; F15B 2201/405
See application file for complete search history.

(56) References Cited

U.S. PATENT DOCUMENTS 3,205,969 A * 9/1965 Clark ..... G01S 1/72 181/142
4,095,421 A * 6/1978 Silcox ..... E21B 33/0355 137/236.1
4,166,478 A * 9/1979 Sugimura ..... F15B 1/10 138/30
7,520,129 B2 * 4/2009 Springett ..... E21B 33/0355 60/398

* cited by examiner

*Primary Examiner* — F. Daniel Lopez
(74) *Attorney, Agent, or Firm* — Buskop Law Group, P.C.; Wendy Buskop

(57) ABSTRACT

A system for storing and releasing hydraulic energy having a controller, a pressure source, a bidirectional valve fluidly connected to the pressure source, an expandable vessel fluidly connected to the bidirectional valve having a plurality of axial folds between first and second ends, and a bidirectional port connected to the pressure source. As the plurality of axial folds expand, a contracted volume of pressure expands increasing stored hydraulic fluid energy in the expandable vessel. As the plurality of axial folds contract, the expanded volume reduces, releasing stored hydraulic fluid energy to nearby subsea equipment on demand as changes in hydraulic fluid energy requirements for the subsea equipment changes. Simultaneously, hydrostatic seawater pressure of seawater on the expandable vessel is counteracted with the hydrostatic pressure of fluid inside the expandable vessel.

6 Claims, 3 Drawing Sheets

SELF-CONTAINED DEPTH COMPENSATED ACCUMULATOR SYSTEM

CROSS REFERENCE TO RELATED APPLICATION

The current application claims priority to and the benefit of U.S. Provisional Patent Application Ser. No. 61/991,836 filed on May 12, 2014, entitled "SELF-CONTAINED DEPTH COMPENSATED ACCUMULATOR SYSTEM." This reference is hereby incorporated in its entirety.

FIELD

The present embodiments generally relate to a subsea accumulator acting as a hydraulic fluid energy storage device for a hydraulic power system.

BACKGROUND

A need exists for a simple accumulator for subsea hydraulic power systems that operates through supply tubes at great distances, some as long as 120 miles from a hydraulic pressure source and at subsea depths as deep as 15,000 feet below sea level.

A need exists for an accumulator which is not spring charged, as when the spring fails, an undetectable loss of hydraulic fluid energy storage occurs.

A need exists for an accumulator which is not piston based because when piston seals leak the hydraulic fluid leaks into the sea.

A need exists for an accumulator usable at deep ocean depths, more than 5,000 feet, which is flexibly constructed and behaves like a spring without being spring charged.

The present embodiments meet these needs.

BRIEF DESCRIPTION OF THE FIGURES

The detailed description will be better understood in conjunction with the accompanying drawings as follows.

Figure 1:
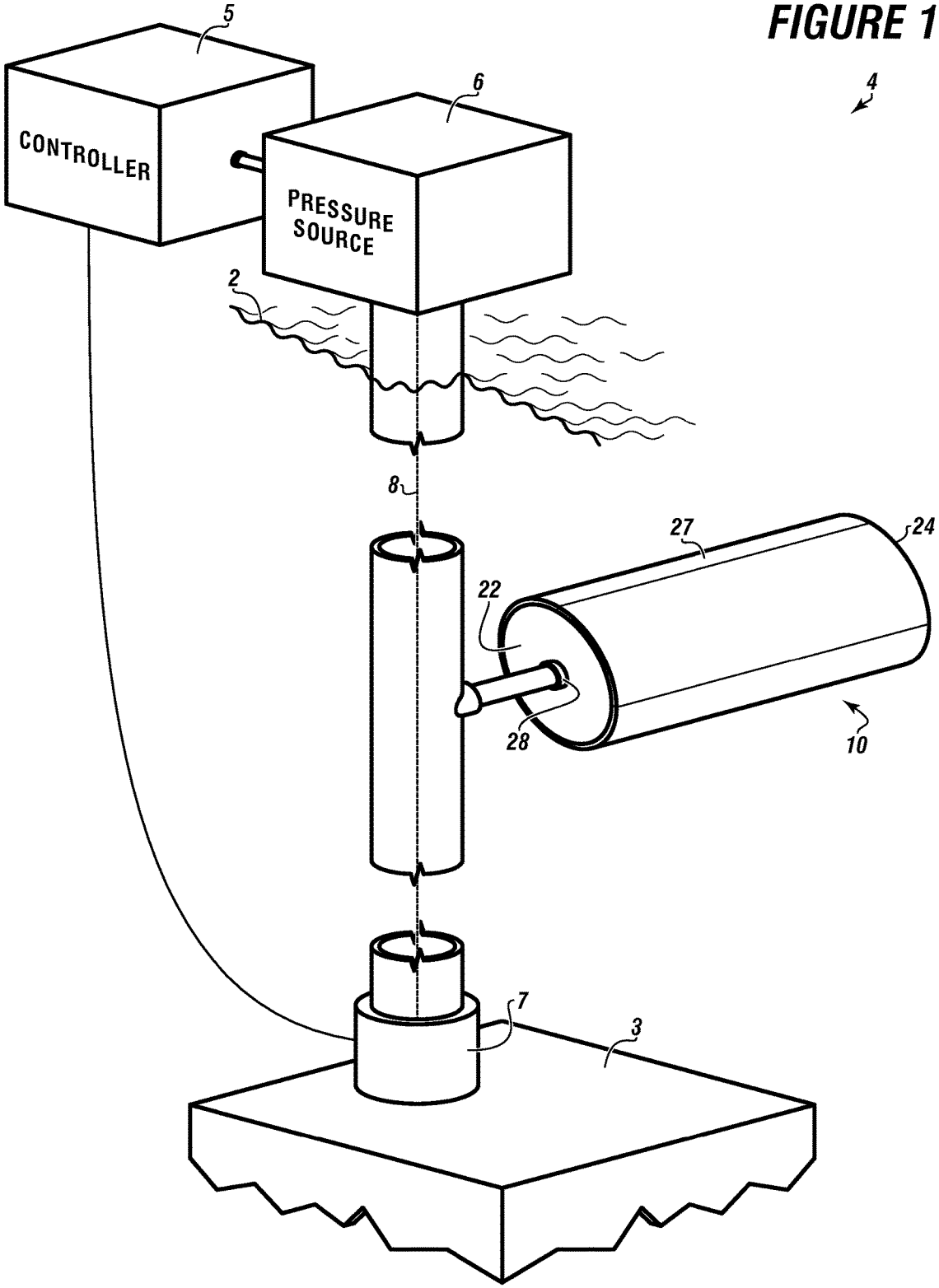
FIG. 1 depicts a diagram of the system with the expandable vessel in a fully expanded configuration according to one or more embodiments.

The present embodiments are detailed below with reference to the listed Figures.

DETAILED DESCRIPTION OF THE EMBODIMENTS

Before explaining the present apparatus and system in detail, it is to be understood that the apparatus and system is not limited to the particular embodiments and that it can be practiced or carried out in various ways.

The present embodiments relate to a subsea accumulator that is depth compensated.

The present embodiments relate to an accumulator for subsea use that can have no piston to stick and cause undetected loss of hydraulic fluid energy storage.

The present embodiments relate to an accumulator that can have no piston seals to leak and cause undetected loss of hydraulic fluid energy polluting the sea.

The present embodiments relate to an accumulator that can have no spring to fail and cause undetected loss of hydraulic fluid energy storage. The loss of hydraulic fluid energy causes loss of subsea equipment which could cause wells to erupt causing pollution and damage to wildlife.

The embodiments relate to a flexible accumulator that can have a flexible outer wall that reacts against the hydrostatic pressure of sea water as variable pressure/volume load can be applied to the flexible accumulator.

The term "bidirectional valve" as used herein can refer to a solenoid operated valve, such as a shuttle valve, a gate valve, a ball valve, a butterfly valve, another three way valve, or another at least two way valve capable of withstanding subsea pressures between the subsea equipment and the expandable vessel, such as from 1,500 psi to 20,000 psi.

The term "commands" as used herein can refer to electronic signals that contain at least one bit of information and instruct the bidirectional valve to change state, such as to open or close, communicating user intent to the bidirectional valve. Commands can be transmitted from a controller to the bidirectional valve.

The term "contracted pressurized volume" as used herein can refer to a hydraulic fluid volume when the pressure source provides the hydraulic fluid at a zero pressure, when the axial folds of the expandable vessel are in an initial folded position, the pressure inside the chamber of the expandable vessel equals hydrostatic pressure of the hydraulic fluid at the depth of the expanded vessel.

The term "controller" as used herein can refer to a surface or subsea device adapted to open or close the bidirectional valve of the embodiments using an electric or electronic signal. The controller can open or close the valve based on needs of subsea equipment for hydraulic fluid energy. In embodiments, the controller can be a computer or a programmable logic circuit with computer instructions in the data storage and a processor connected to the data storage.

The term "expanded pressurized volume" as used herein can refer to a hydraulic fluid volume when the pressure source provides the hydraulic fluid at an operating pressure, when the axial folds of the expandable vessel are in an expanded position, the pressure inside the chamber of the expandable vessel equals hydrostatic pressure of the hydraulic fluid at the depth of the expanded vessel plus the operating pressure.

The term "hydraulic fluid" as used herein can refer to oils, water, or another mixture of liquid chemicals, such as corrosion preventive chemicals, which can be pressurized to form hydraulic fluid energy.

The term "hydraulic fluid energy" as used herein can refer to a hydraulic fluid volume which has been pressurized forming hydraulic energy.

The term "pressure source" as used herein can refer to a hydraulic fluid source, such as a tank of hydraulic fluid volume and a pressure pump at sea level which supplies hydraulic fluid energy to the expandable vessel. In embodiments, the pressure pump can operate from 1,500 psi to 20,000 psi.

The term "subsea equipment" as used herein can refer to equipment that can be installed and operating under water, at depths from 30 feet to 20,000 feet and can include but is not limited to blow out preventers, manifolds, Christmas trees, conduits, tubulars, flow line systems, subsea cleaning devices, remotely operated vehicles (ROV) and subsea processing systems.

The embodiments further relate to a self-contained expandable automatic pressure compensated accumulator system for storing and releasing hydraulic fluid energy for use by subsea equipment.

The system can include a pressure source connected to the controller for supplying hydraulic fluid at a defined pressure as "hydraulic fluid energy".

The system can include a bidirectional valve connected fluidly to the pressure source for transmitting hydraulic fluid energy to subsea equipment.

The bidirectional valve can be electrically connected to the controller for controlling hydraulic fluid energy to and from the subsea equipment based on commands from the controller.

The system can include an expandable vessel fluidly connected to the bidirectional valve.

The expandable vessel can have a first end and a second end. The expandable vessel can have a longitudinal axis between the first end and the second end.

The expandable vessel can have a plurality of axial folds formed contiguously between the first end and the second end creating an outer wall of the expandable vessel.

In embodiments, a pressure containing chamber can be formed between the plurality of axial folds and the first and second ends.

The pressure containing chamber can be configured to have a contracted pressurized volume and an expanded pressurized volume.

The expandable vessel can have a bidirectional port formed in the first end or in the second end. In embodiments, the bidirectional port can be formed along the longitudinal axis.

The bidirectional port can connect simultaneously and in parallel to the pressure source and the bidirectional valve.

The bidirectional port can be configured to provide a bidirectional flow of hydraulic fluid energy to the bidirectional valve from the pressure containing chamber and a bidirectional flow of hydraulic fluid energy to the pressure containing chamber from the pressure source.

The embodiments operate so that when the plurality of axial folds expand away from the longitudinal axis, the contracted volume of the pressure containing chamber expands towards an expanded volume increasing stored hydraulic fluid energy in the pressurized chamber, and as the plurality of axial folds contract towards the longitudinal axis, the expanded volume of the pressurized chamber reduces, releasing stored hydraulic fluid energy, enabling the expandable vessel to store retrievable subsea hydraulic fluid energy in close proximity to the subsea equipment and release the stored hydraulic fluid energy on demand as changes in hydraulic fluid energy requirements for the subsea equipment changes, while the expandable vessel simultaneously counteracts the hydrostatic seawater pressure of seawater outside of the expandable vessel with the hydrostatic pressure of hydraulic fluid inside the pressurized chamber.

In embodiments, the self-contained expandable automatic pressure compensated accumulator system can have an expandable vessel with 3 folds to 20 folds.

In embodiments, the self-contained expandable automatic pressure compensated accumulator system supplies hydraulic power to subsea equipment. Examples of subsea equipment can include but is not limited to a blowout preventer, a conduit, a tubular, a subsea Christmas tree, and a subsea manifold.

Turning now to the Figures, FIG. 1 depicts a diagram of the system with the expandable vessel in a fully expanded configuration according to one or more embodiments.

The self-contained expandable automatic pressure compensated accumulator system 4 can include a pressure source 6 at the surface of water 2, which can be controlled by a controller 5 to provide hydraulic fluid 8 to a bidirectional port 28 formed in a first end 22 of an expandable vessel 10.

The expandable vessel 10 can have an outer wall 27 formed between the first end 22 and a second end 24.

The bidirectional port 28 can be connected to both the pressure source 6 and a bidirectional valve 7 that controls hydraulic fluid 8 that flows to subsea equipment 3.

The bidirectional port 28 not only provides a bidirectional flow of hydraulic fluid 8 to the bidirectional valve from the expandable vessel 10 but can also provide a bidirectional flow of hydraulic fluid 8 to the expandable vessel 10 from the pressure source 6.

The controller 5 can be in electronic communication with the bidirectional valve 7 and can communicate to the subsea equipment 3.

Figure 2A:
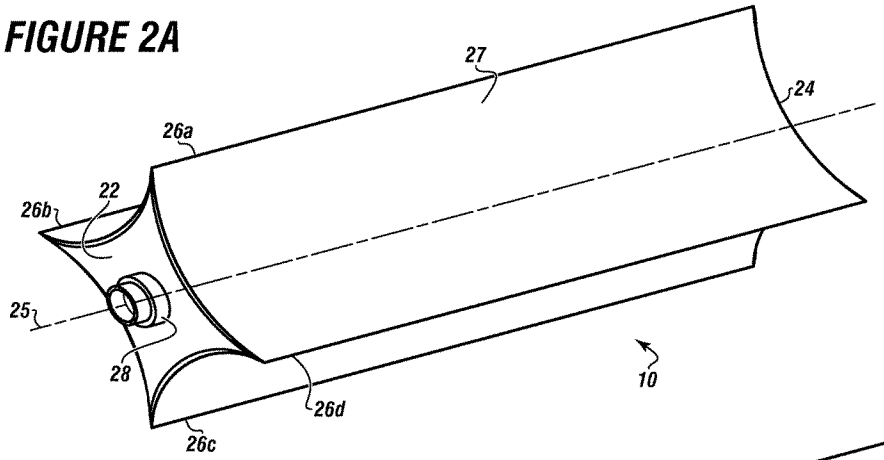
FIG. 2A depicts a top perspective view of the expandable vessel in a fully contracted configuration according to one or more embodiments.

FIG. 2A depicts a top perspective view of the expandable vessel 10 with a longitudinal axis 25 that passes through the bidirectional port 28 in a fully contracted configuration according to one or more embodiments.

In this embodiment, the bidirectional port 28 can be formed in the first end 22 of the contracted configuration.

In this configuration, a plurality of axial folds 26*a*, 26*b*, 26*c*, and 26*d* can be formed contiguously between the first end 22 and the second end 24 creating the outer wall 27 of the expandable vessel 10.

Figure 2B:
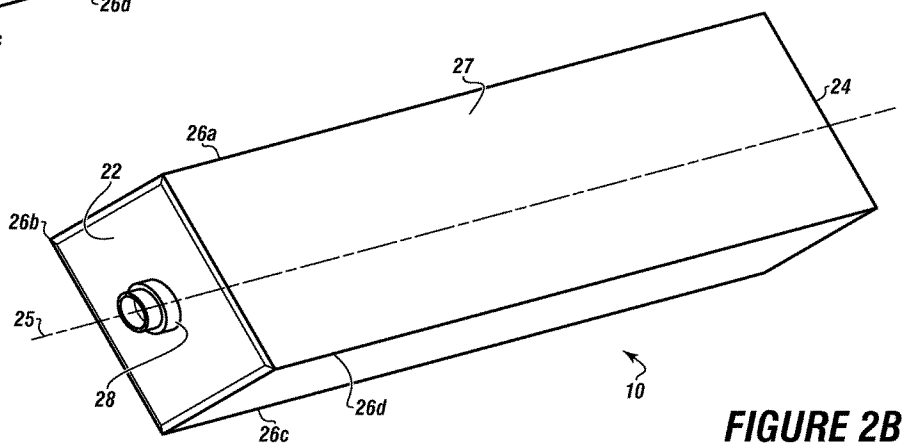
FIG. 2B depicts a top perspective view of the expandable vessel in a partially expanded configuration according to one or more embodiments.

FIG. 2B depicts a top perspective view of the expandable vessel 10 in a partially expanded configuration according to one or more embodiments.

The plurality of axial folds 26*a*, 26*b*, 26*c*, and 26*d* can be formed contiguously between the first end 22 and the second end 24 creating a square like shape to the outer wall 27 of the expandable vessel 10.

In this embodiment, the bidirectional port 28 is shown formed in the first end 22 of the partially expanded configuration.

The longitudinal axis 25 is depicted passing through the center of the bidirectional port 28.

Figure 3:
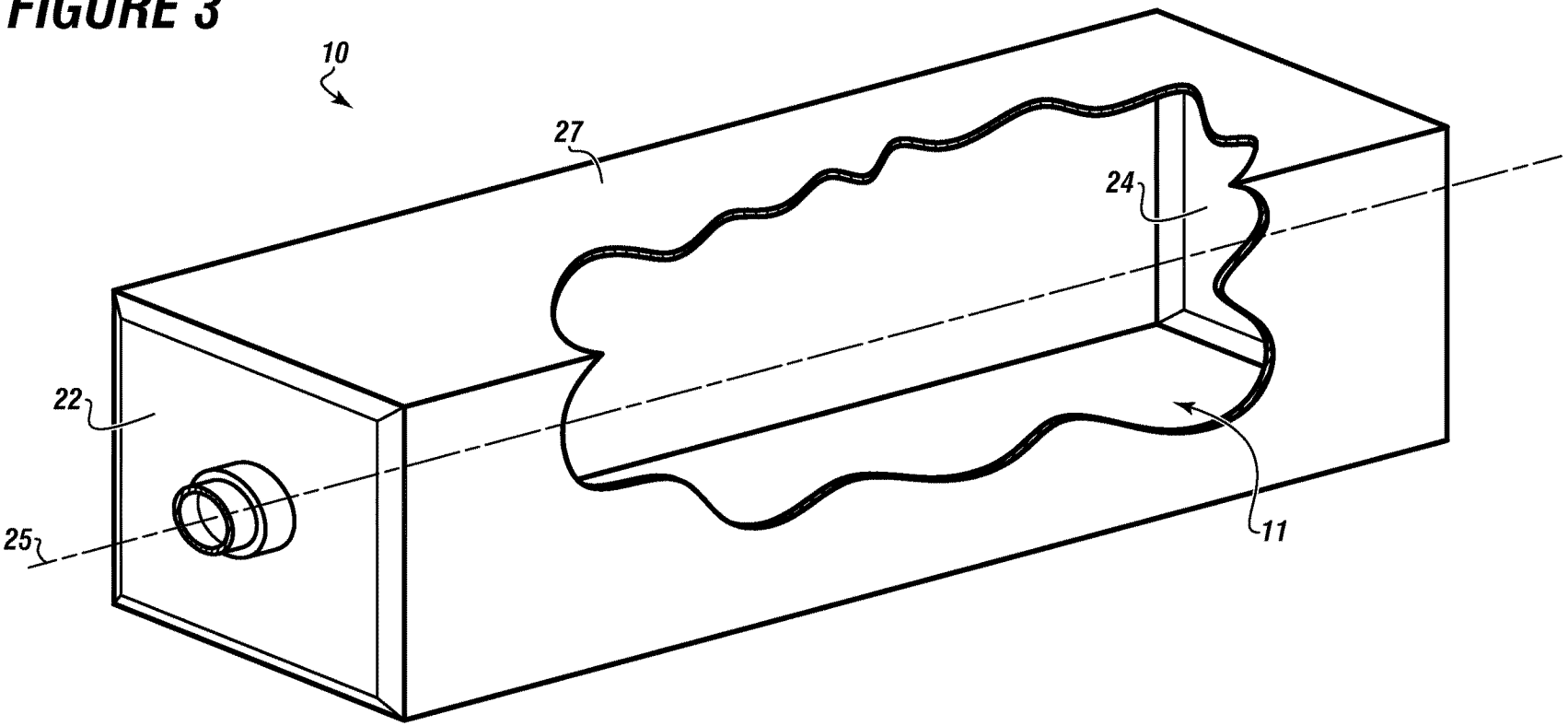
FIG. 3 depicts a partially cut away view of the expandable vessel in the partially expanded configuration according to one or more embodiments.

FIG. 3 depicts a partially cut away view of the expandable vessel 10 with longitudinal axis 25 in the partially expanded configuration according to one or more embodiments.

The expandable vessel 10 is shown with the outer wall 27 and the second end 24 opposite the first end 22. In this embodiment, the pressure containing chamber 11 can be configured to have a contracted pressurized volume and an expanded pressurized volume.

The longitudinal axis 25 is depicted passing through the center of the bidirectional port.

A typical subsea piston actuated gate valve will need local accumulation to prevent sympathetic closure of other valves on the same piece of subsea equipment when it is opened. The sympathetic closure is caused by the combination of fail-safe valve construction and pipe period.

Subsea valves are designed to fail-safe and not latch; i.e. they have to be held in position with pressure and will start to close if there is any reduction in local pressure below that required to hold them open. An example valve will start to open at 500 psi and be fully open at 1,000 psi. If there is already one valve open and there is no other pressure source, a command to open a second valve will cause the two valves to equalize at 50 percent open and 750 psi, also called "sympathetic closure".

The low pressure, such as 500 psi start to open, caused by commanding a valve open travels at the speed of sound; typically 1 second to 5 seconds per mile depending on the control fluid and tubing wall design. This low pressure impulse travels from the valve to the pressure source and back again before fluid begins to flow into the actuator from the pressure source and is also called the "pipe period"; i.e. the pipe period equals the offset distance/half the speed of sound.

Given an average pipe period of 6 seconds per mile and typical valve travel period of 20 seconds from closed to open; any valve that is operated at distances greater than 3 miles to 4 miles from the pressure source will complete its opening before fluid begins to flow into it from the remote pressure source. Partially open valves will cause excessive wear to the valve by rubbing against seals and allowing the produced fluids to cut the gate. This valve wear causes the valve to leak and can lead to excessive discharge of reservoir fluids to the sea in the event of the loss of containment. Worn valves have to be replaced at extremely high cost due to their location on the seafloor and criticality to safe operation.

A typical control system will have an operating pressure of 5,000 psi. Therefore, a local accumulator can be sized to have sufficient usable volume to fill the largest valve actuator on the subsea equipment while maintaining a minimum of 1,000 psi and thereby preventing sympathetic closure of other valves.

In embodiments, the expandable vessel when partially expanded can have a square shape. In other embodiments, the expandable vessel when fully expanded can have a round shape.

The expandable vessel can be expandable and retracted, expanding from the contracted state, to the square state, to the round state, back to the square state, and then to the contracted state.

The expandable vessel can be from 1 foot to 20 feet long, with an initial diameter of 4 inches to 24 inches in diameter.

The thickness of the outer wall of the expandable vessel can vary from 1/16th of an inch to 6 inches, depending on the pressure source operating pressure.

In embodiments, the expandable vessel can be a one piece construction of steel, such as stainless steel or "spring steel" which can be a high strength steel, capable of sustaining 50 ksi.

In embodiments, the expandable vessel can be made from a first material for the first and second ends, and a second material for the plurality of axial folds. In embodiments, the first and second ends can be formed from a galvanic compatible material and the plurality of axial folds can be formed from the "spring steel" such as grade ASTM Grade A666 spring steel.

In embodiments, the controller can be remotely controlled from a client device connected to a network that further communicates with the controller, such as a laptop, a computer, a cellular phone, a tablet, or a similar device.

In embodiments, as the plurality of axial folds expand away from the longitudinal axis, the contracted volume of the pressure containing chamber expands towards an expanded volume increasing stored hydraulic fluid energy in the pressure containing chamber. In embodiments, the plurality of axial folds can expand away from the longitudinal axis from 0.001 of a percent to 20 percent of the overall diameter of the expandable vessel.

In embodiments, the expansion of the plurality of axial folds can occur in milliseconds. Similarly, the contraction of the plurality of axial folds can occur in milliseconds.

Similarly, as the plurality of axial folds contract towards the longitudinal axis, the expanded volume of the pressurized chamber reduces releasing stored hydraulic fluid energy, enabling the expandable vessel to store retrievable subsea hydraulic fluid energy in close proximity to the subsea equipment and release the stored hydraulic fluid energy on demand as changes in hydraulic fluid energy requirements for the subsea equipment changes, while the expandable vessel simultaneously counteracts the hydrostatic seawater pressure of seawater outside of the expandable vessel with the hydrostatic pressure of hydraulic fluid inside the pressurized chamber. In embodiments, the plurality of axial folds can retract from 0.001 of a percent to 20 percent of the overall diameter of the expandable vessel.

The plurality of axial folds can expand and retract without frictional losses.

While these embodiments have been described with emphasis on the embodiments, it should be understood that within the scope of the appended claims, the embodiments might be practiced other than as specifically described herein.

What is claimed is:

1. A self-contained expandable automatic pressure compensated accumulator system for storing and releasing hydraulic fluid energy for use by subsea equipment, the self-contained expandable automatic pressure compensated accumulator system comprising:

a. a controller;

b. a pressure source connected to the controller for supplying hydraulic fluid at a defined pressure as hydraulic fluid energy;

c. a bidirectional valve connected: (i) fluidly to the pressure source for transmitting hydraulic fluid energy to subsea equipment; and (ii) electrically connected to the controller for controlling hydraulic fluid energy to and from the subsea equipment based on commands from the controller; and d. a rectangular six sided expandable vessel fluidly connected to the bidirectional valve, the expandable vessel comprising:

(i) a first end;

(ii) a second end opposite the first end;

(iii) a longitudinal axis between the first end and the second end; (iv) a plurality of axial folds formed contiguously between the first end and the second end creating:

1. a flexible outer wall of the expandable vessel; and 2. a pressure containing chamber configured to have a contracted pressurized volume and an expanded pressurized volume; and (v) a bidirectional port formed in the first end or the second end connected to the pressure source and the bidirectional valve, wherein the bidirectional port is configured for:

1. a flow of hydraulic fluid energy to the bidirectional valve from the pressure containing chamber; and 2. a flow of hydraulic fluid energy to the pressure containing chamber from the pressure source; and wherein, as the expandable vessel 10 receives hydraulic fluid energy from the pressure source, the plurality of axial folds forms the flexible outer wall that expands away from the longitudinal axis, the contracted volume of the pressure containing chamber expands towards an expanded volume forming the movable flexible outer wall that increases stored hydraulic fluid energy in the pressure containing chamber, and as expandable vessel receives a demand for hydraulic fluid energy from the subsea equipment, the plurality of axial folds contract towards the longitudinal axis, the expanded volume of the pressure containing chamber reduces releasing stored hydraulic fluid energy, enabling the expandable vessel to store retrievable subsea hydraulic fluid energy in close proximity to the subsea equipment and release the stored hydraulic fluid energy on demand as changes in hydraulic fluid energy requirements for the subsea equipment changes, while the expandable vessel simultaneously counteracts the hydrostatic seawater pressure of seawater outside of the flexible outerwall of the expandable vessel with the hydrostatic pressure of hydraulic fluid inside the pressure containing chamber.

2. The self-contained expandable automatic pressure compensated accumulator system of claim 1, wherein the expandable vessel comprises 4 folds.

3. The self-contained expandable automatic pressure compensated accumulator system of claim 1, wherein the subsea equipment is at least one of: a blowout preventer, a tubular, a subsea Christmas trees, and a subsea manifold.

4. An expandable vessel for storing and releasing hydraulic fluid energy for use by subsea equipment, fluidly connected to both a pressure source and the subsea equipment, the expandable vessel being rectangular and six sided comprising:

(i) a first end;

(ii) a second end opposite the first end;

(iii) a longitudinal axis between the first end and the second end;

(iv) a plurality of axial folds formed contiguously between the first end and the second end, creating:

1. a flexible outer wall of the expandable vessel; and
2. a pressure containing chamber configured to have a contracted pressurized volume and an expanded pressurized volume; and (v) a bidirectional port formed in the first end or the second end connected to the pressure source and the bidirectional valve, wherein the bidirectional port is configured for:

1. a flow of hydraulic fluid energy to the bidirectional valve from the pressure containing chamber; and
2. a flow of hydraulic fluid energy from the pressure source to the pressure containing chamber; and wherein, as the expandable vessel 10 receives hydraulic fluid energy from the pressure source, the plurality of axial folds forms the flexible outer wall that expands away from the longitudinal axis, the contracted volume of the pressure containing chamber expands towards an expanded volume forming the movable flexible outer wall that increases stored hydraulic fluid energy in the pressure containing chamber, and as expandable vessel receives a demand for hydraulic fluid energy from the subsea equipment, the plurality of axial folds contract towards the longitudinal axis, the expanded volume of the pressure containing chamber reduces releasing stored hydraulic fluid energy, enabling the expandable vessel to store retrievable subsea hydraulic fluid energy in close proximity to the subsea equipment and release the stored hydraulic fluid energy on demand as changes in hydraulic fluid energy requirements for the subsea equipment changes, while the expandable vessel simultaneously counteracts the hydrostatic seawater pressure of seawater outside of the flexible outerwall of the expandable vessel with the hydrostatic pressure of hydraulic fluid inside the pressure containing chamber.

5. The expandable vessel of claim 4, further comprising 4 folds.

6. The expandable vessel of claim 4, wherein the subsea equipment is at least one of: a blowout preventer, a tubular, a subsea Christmas trees, and a subsea manifold.

* * * * *